US006191755B1

(12) United States Patent
Hamaaratsu

(10) Patent No.: US 6,191,755 B1
(45) Date of Patent: Feb. 20, 2001

(54) TWO-RESONANCE HELICAL ANTENNA CAPABLE OF SUPPRESSING FLUCTUATION IN ELECTRICAL CHARACTERISTIC WITHOUT RESTRICTION IN SIZE OF A HELICAL COIL

(75) Inventor: Iwao Hamaaratsu, Sendai (JP)

(73) Assignee: Tokin Corporation, Miyagi (JP)

( * ) Notice: Under 35 U.S.C. 154(b), the term of this patent shall be extended for 0 days.

(21) Appl. No.: 09/394,780

(22) Filed: Sep. 13, 1999

(30) Foreign Application Priority Data

Sep. 25, 1998 (JP) ..... 10-271726

(51) Int. Cl.[7] ..... H01Q 1/36
(52) U.S. Cl. ..... 343/895; 343/702; 455/90
(58) Field of Search ..... 343/895, 702; 455/575, 90

(56) References Cited

U.S. PATENT DOCUMENTS 5,559,524 * 9/1996 Takei et al. ..... 343/895
5,717,409 2/1998 Garner et al. ..... 343/702

FOREIGN PATENT DOCUMENTS 198 58 090 A1 6/1999 (DE) .
3-236612 10/1991 (JP) .
9-69723 3/1997 (JP) .
WO 98/02936 1/1998 (WO) .
WO 99/39403 8/1999 (WO) .
WO 99/48169 9/1999 (WO) .

OTHER PUBLICATIONS

Y. Kazama: "A Quadrifilar Helical Antenna with a Parasitic Loop", Digest of the Antennas and Propagation Society International Symposium, U.S., New York, IEEE, pp. 1016–1019, XP000545586 ISBN: 0–7803–2009–3—entire document.

* cited by examiner

*Primary Examiner*—Don Wong
*Assistant Examiner*—James Clinger
(74) *Attorney, Agent, or Firm*—Frishauf, Holtz, Goodman, Langer & Chick, P.C.

(57) ABSTRACT

In a two-resonance helical antenna, a single helical coil (3) is made of a conductive material and extends in one axis direction. An annular conductor portion (5) is arranged around the helical coil in a coaxial fashion to be spaced and insulated from the helical coil. The annular conductor portion is positioned in a middle portion of the helical coil in the one axis direction.

4 Claims, 5 Drawing Sheets

TWO-RESONANCE HELICAL ANTENNA CAPABLE OF SUPPRESSING FLUCTUATION IN ELECTRICAL CHARACTERISTIC WITHOUT RESTRICTION IN SIZE OF A HELICAL COIL

BACKGROUND OF THE INVENTION

This invention relates to a helical antenna typically mounted on a mobile terminal equipment for mobile communication and, in particular, to a two-resonance helical antenna.

A two-resonance helical antenna comprises a conductive holder having a threaded portion serving as a feeding portion, a pair of helical coils made of a conductive material and different in bore size or inner diameter from each other, and a pair of nonconductive guides made of a dielectric material and different in inner diameter from each other. The helical coils are smaller and greater in inner diameter and may be called a smaller helical coil and a greater helical coil, respectively. Likewise, the nonconductive guides are smaller and greater in inner diameter and may be called a smaller guide and a greater guide, respectively. The helical coils are connected to the conductive holder through the nonconductive guides, respectively, and arranged in a coaxial fashion. The nonconductive guides serve to prevent the deformation and the unstableness of the helical coils. Finally, a combination of the helical coils and the nonconductive guides is covered with a nonconductive cover.

In the two-resonance helical antenna thus assembled, the greater helical coil is fitted onto an outer peripheral surface of the greater guide of a cylindrical shape. Inside an inner peripheral surface of the greater guide, the smaller guide of a rod-like shape is arranged with the smaller helical coil fitted on its outer peripheral surface. The two helical coils are different in electrical length. The greater helical coil as an outer helical coil carries a lower resonance frequency as a first resonance frequency while the smaller helical coil as an inner helical coil carries a higher resonance frequency as a second resonance frequency.

The two-resonance helical antenna of the above-mentioned structure has several limitations imposed upon its design.

At first, in order to utilize the characteristic of the two helical coils lower in height than a linear conductor, the inner helical coil is required to have a relatively large inner diameter. Therefore, the outer helical coil is inevitably increased in inner diameter.

Second, the two helical coils are connected in parallel and arranged in a coaxial fashion. This is a bar to reduction in size of the antenna as a whole because the sizes of the helical coils (particularly, the size of the inner helical coil) are limited due to the above-mentioned arrangement.

Third, since the two helical coils overlap each other, the helical coils interfere with each other in their electric characteristics. Therefore, a resulting electric characteristic is different from that obtained by either one of the helical coils. If a parameter of one of the helical coils is changed, both of the first and the second resonance frequencies will be changed. Accordingly, in order to tune these frequencies with a desired frequency band, it is required to simultaneously adjust parameters of the two helical coils. This means that the variation in shape of the two helical coils gives a double influence upon the electric characteristic. Therefore, such variation in shape must be suppressed as much as possible.

However, the two-resonance helical antenna in the previous technique has a basic structure that the helical coils are arranged in a coaxial fashion to overlap each other. Therefore, the sizes of the helical coils are restricted and only a small degree of freedom is allowed. In addition, the reduction in size of the antenna as a whole is limited. Furthermore, the helical coils interfere with each other so that the variation in their shapes results in wide fluctuation in electric characteristic. Thus, the two-resonance helical antenna has various disadvantages in its structure.

SUMMARY OF THE INVENTION

It to a technical object of the present invention to provide a two-resonance helical antenna which can be reduced in size of the antenna as a whole without restriction in size of a helical coil and which is capable of suppressing fluctuation in electric characteristic.

Other objects of the present invention will become clear as the description proceeds.

According to this invention, there is provided a two-resonance helical antenna which comprises a single helical coil made of a conductive material and extending in one axis direction and an annular conductor portion arranged around the helical coil in a coaxial fashion to be spaced and insulated from the helical coil, the annular conductor portion being positioned in a middle portion of the helical coil in the one axis direction.

It may be arranged that the helical coil and the conductor portion are spaced from each other by a distance x satisfying $0<x<0.1\lambda$, where $\lambda$ represents a wavelength of a resonance frequency which is variable in response to the distance.

It may be arranged that the two-resonance helical antenna further comprises a conductive holder having a threaded portion serving as a feeding portion and a cylindrical guide of a dielectric material fixedly attached to the holder and arranged around the helical coil to be spaced and insulated therefrom, the conductor portion being formed by plating or vapor-depositing a conductive material in a local area on an outer peripheral surface of the guide.

It may be arranged that the two-resonance helical antenna further comprises a conductive holder having a threaded portion serving as feeding portion, a rod-like guide made of a dielectric material fixedly attached to the holder, with the helical coil being fitted onto an outer peripheral surface of the guide, and a nonconductive cover fixedly attached to the holder and covering an end portion of the holder and a whole of the guide with the helical coil fitted thereto, the conductor portion being formed as a spring member fixedly attached to an inner wall of the cover.

DESCRIPTION OF THE PREFERRED EMBODIMENTS

In order to facilitate an understanding of this invention, description will at first be made about a two-resonance helical antenna in a previous technique.

Figure 1A:
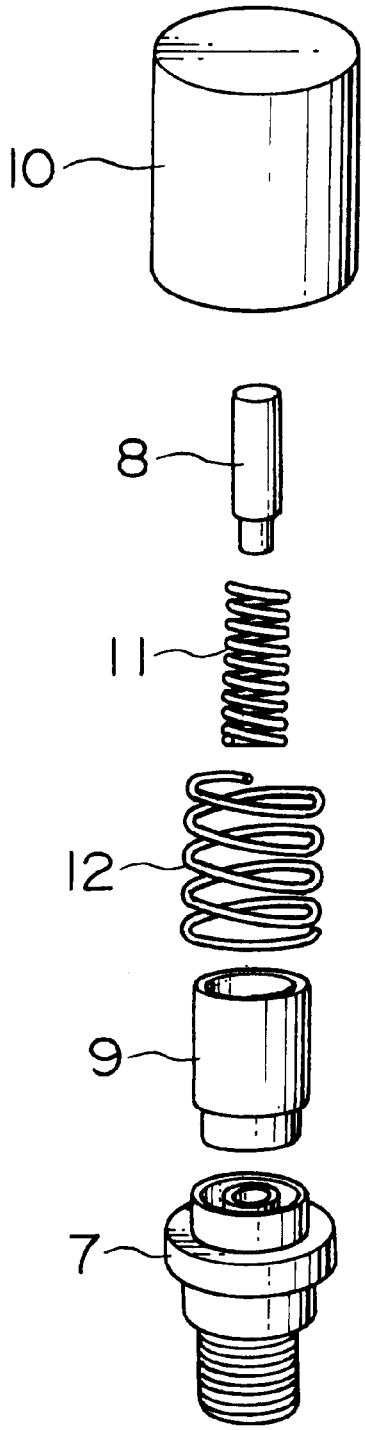
FIG. 1A PRIOR ART
FIGS. 1A and 1B are an exploded perspective view and a partially-sectional side view of a two-resonance helical antenna in a previous technique, respectively.
Figure 1B:
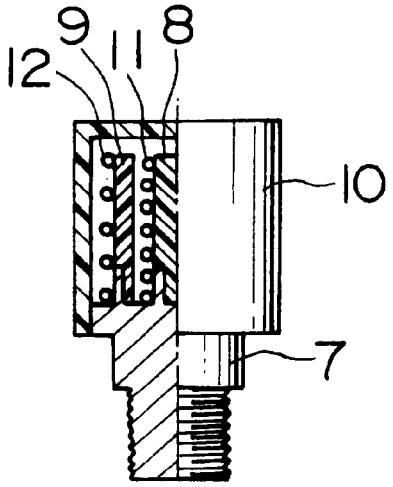
FIG. 1B PRIOR ART

Referring to FIGS. 1A and 1B, the two-resonance helical antenna in the previous technique comprises a conductive holder 7 connected to a mobile terminal equipment (not shown) and having a threaded portion serving as a feeding portion, a pair of helical coils 11 and 12 made of a conductive material and different in inner diameter from each other, and a pair of nonconductive guides 8 and 9 made of a dielectric material and different in inner diameter from each other. The helical coils 11 and 12 are smaller and greater in inner diameter and may be called a smaller helical coil 11 and a greater helical coil 12, respectively. Likewise, the nonconduotive guides 8 and 9 are smaller and greater in inner diameter and may be called a smaller guide 8 and a greater guide 9, respectively. The helical coils 11 and 12 are connected to the holder 7 through the nonconductive guides 8 and 9, respectively, and arranged in a coaxial fashion. The nonconductive guides 8 and 9 serve to prevent the deformation and the unstableness of the helical coils 11 and 12. Finally, a combination of the helical coils 11 and 12 and the nonconductive guides 8 and 9 is covered with a nonconductive cover 10.

Specifically, in the two-resonance helical antenna thus assembled, the greater helical coil 12 to fitted onto an outer peripheral surface of the greater guide 9 of a cylindrical shape. Inside an inner peripheral surface of the greater guide 9, the smaller guide 8 of a rod-like shape is arranged with the smaller helical coil 11 fitted on its outer peripheral surface.

The helical coils 11 and 12 are different In electrical length. The greater helical coil 12 as an outer helical coil carries a lower resonance frequency as a first resonance frequency F1 while the smaller helical coil 11 as an inner helical coil carries a higher resonance frequency as a second resonance frequency F2.

The two-resonance helical antenna of the above-mentioned structure has several limitations imposed upon its design.

At first, in order to utilize the characteristic of the two helical coils 11 and 12 lower in height than a linear conductor, the inner helical coil 11 is required to have a relatively large inner diameter. Therefore, the outer helical coil 12 is inevitably increased in inner diameter. Second, the two helical coils 11 and 12 are connected in parallel and arranged in a coaxial fashion. This is a bar to reduction in size of the antenna as a whole because the sizes of the helical coils 11 and 12 (particularly, the size of the inner helical coil 12) are limited due to the above-mentioned arrangement. Third, since the two helical coils 11 and 12 overlap each other, the helical coils 11 and 12 interfere with each other in their electric characteristics. Therefore, a resulting characteristic is different from that obtained by either one of the helical coils 11 and 12. If a parameter of one of the helical coils 11 and 12 is changed, both of the first and the second resonance frequencies F1 and F2 will be changed. Accordingly, in order to tune these frequencies with a desired frequency band, it is required to simultaneously adjust parameters of the two helical coils 11 and 12. This means that the variation in shape of the two helical coils 11 and 12 gives a double influence upon the electric characteristic. Therefore, such fluctuation in shape must be suppressed as much as possible.

However, the two-resonance helical antenna in the previous technique has a basic structure that the helical coils 11 and 12 are arranged in a coaxial fashion to overlap each other. Therefore, the sizes of the helical coils 11 and 12 (in particular, the inner helical coil 12) are restricted and have only a small degree of freedom is allowed. In addition, the reduction in size of the antenna as a whole is limited. Furthermore, the helical coils 11 and 12 interfere with each other so that the variation in their shapes results in wide fluctuation in electric characteristic. Thus, the two-resonance helical antenna has various disadvantages in its structure.

Now, description will be made in detail about embodiments of this invention.

Figure 2A:
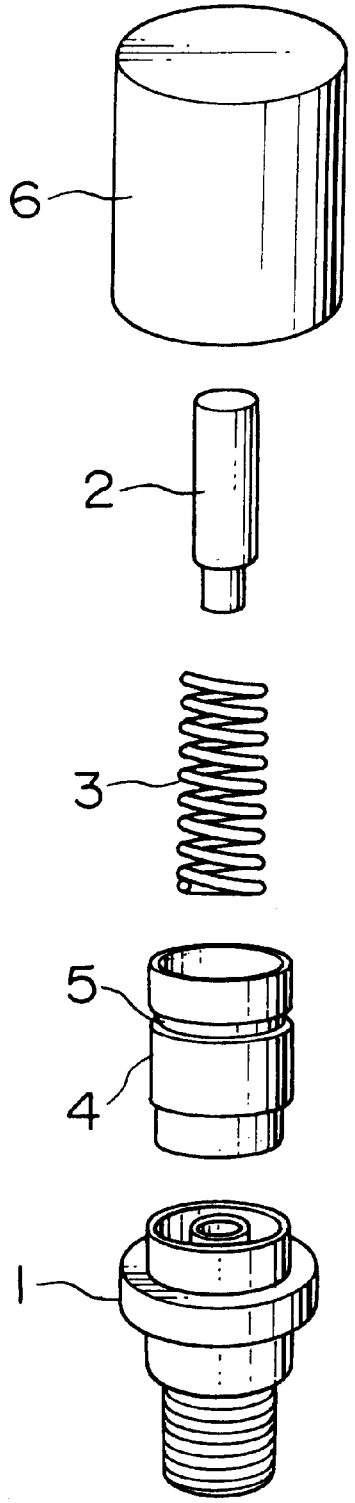
FIGS. 2A and 2B are an exploded perspective view and a partially-sectional side view of a two-resonance helical antenna according to a first embodiment of this invention.
Figure 2B:
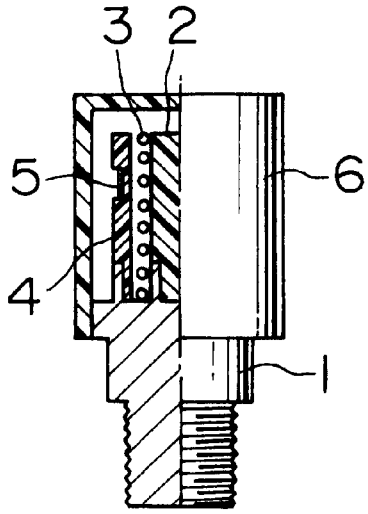

At first referring to FIGS. 2A and 2B, a two-resonance helical antenna according to a first embodiment of this invention comprises a holder 1 made of a conductive material, a rod-shaped guide 2 made of a dielectric material and having a small inner diameter, and a single helical coil 3 made of a conductive material, having a small inner diameter, and extending in one axis direction. The helical coil 3 is fitted to an outer peripheral surface of the guide 2 which serves to prevent the deformation and the unstableness of the helical coil 3. The guide 2 with the helical coil 3 fitted to its outer peripheral surface is fixedly attached to the holder 1. The helical antenna further comprises a cylindrical guide 4 made of a dielectric material and having a greater inner diameter. The cylindrical guide 4 is provided with a conductor portion 5 of an annular shape formed by plating or vapor-depositing a conductive material in a local area on an outer peripheral surface of the cylindrical guide 4. The guide 4 is fixedly attached to the holder 1 so that the guide 4 is arranged around the helical coil 3 to be spaced and insulated therefrom. Finally, the above-mentioned components are covered with a nonconductive cover 6. Thus, the above-mentioned components are connected and arranged in a coaxial fashion.

In the two-resonance helical antenna thus assembled, the conductor portion 5 is formed in the local area on the outer peripheral surface of the guide 4. The guide 2 with the helical coil 3 fitted on its outer peripheral surface is arranged inside an inner peripheral surface of the guide 4. The conductor portion 5 is arranged around the helical coil 3 in a coaxial fashion to be spaced and insulated from the helical coil 3 and is positioned in a middle portion of a dimensional range of the helical coil 3 in the one axis direction. It is noted here that the helical coil 3 and the conductor portion 5 are spaced from each other at a distance x satisfying $0<x<0.1\lambda$, where $\lambda$ represents a wavelength of a resonance frequency (namely, the second resonance frequency F2) which is variable in response to the distance x.

As illustrated in FIGS. 2A and 2B, the conductor portion 5 is arranged at a level lower than the height of the helical coil 3. More in detail, the bottom end of the conductor portion 5 is arranged above the bottom end of the helical coil 3 while the top end of the conductor portion 5 is arranged below the top end of the helical coil 3.

The holder 1 is connected to a mobile terminal equipment (not shown). The holder 1 is made of a conductive material such as brass and has a threaded portion serving as a feeding portion. The helical coil 3 is made of a phosphor bronze wire formed into a helical shape and to electrically connected to the holder 1. The guide 2 is made of a dielectric material and supports the helical coil 3 fitted to its outer peripheral surface in tight contact therewith. It is thus possible to prevent the deformation and the unstableness of the helical coil 3. For example, the guide 2 is made of resin. On the other hand, the guide 4 is made of a dielectric material such as resin and has the conductor portion 5 made of a metal material such as aluminum. For example, the conductor portion 5 is formed by vapor deposition in the local area on the outer peripheral surface of the guide 4. By fixedly attaching the cover 6 to an end portion of the holder 1, the above-mentioned components are entirely covered so as to prevent the ingress of dust from outside.

In the two-resonance helical antenna having the above-mentioned structure, use Is made of the single helical coil 3 with the conductor portion 5 formed around the helical coil 3 In a coaxial fashion to be spaced and insulated from the helical coil 3. The conductor portion 5 is positioned in a middle portion of a dimensional range of the helical coil 3 in the one axis direction. With this structure, a floating capacitance is produced between the conductor portion 5 and the helical coil 3. Therefore, parallel resonance is obtained between the floating capacitance and the inductance of the conductor portion 5 with a first resonance frequency F1 determined by the electrical length of the helical coil 3.

It is assumed that the helical coil 3 has a local area exposed out of the conductor portion 5. In this case, the parallel resonance has a second resonance frequency F2 of a desired level because the local area does not face the conductor portion 5 and is electrically isolated from the conductor portion 5. Thus, the first resonance frequency F1 is determined by the electrical length of the helical coil 3 while the second resonance frequency F2 is determined by the position of the conductor portion 5.

Figure 3:
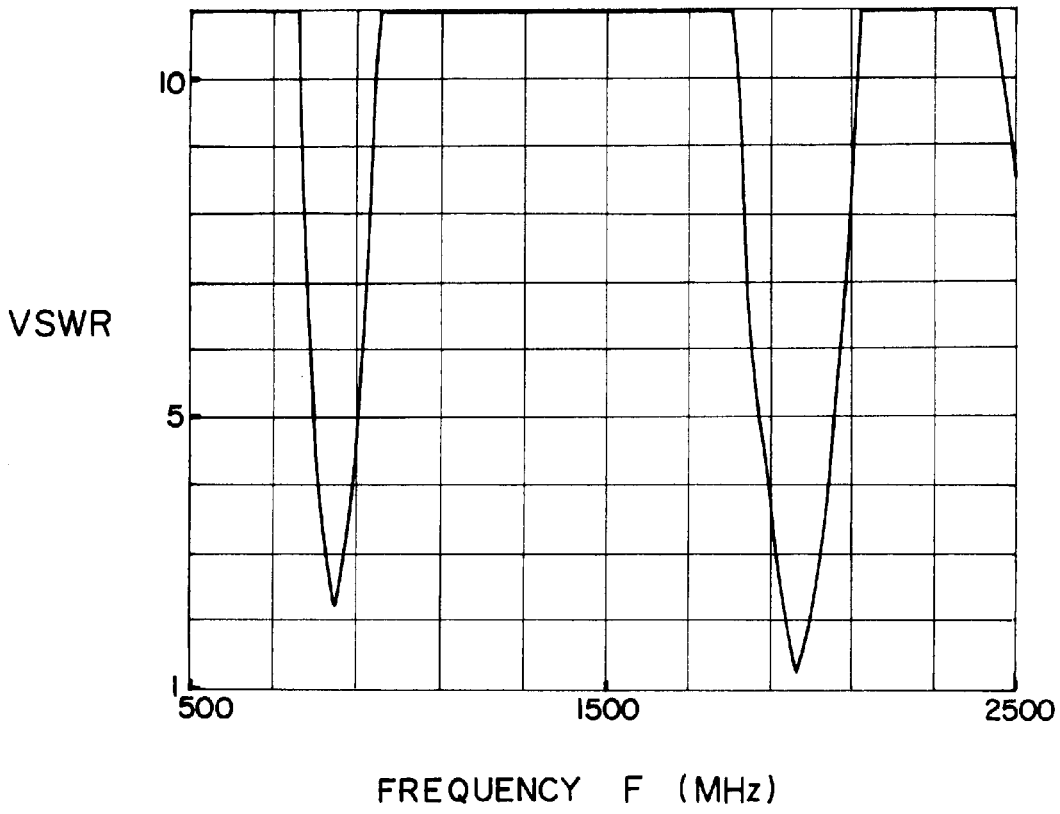
FIG. 3 is a graph showing the result of measurement of a VSWR (Voltage/Standing Wave Ratio) versus frequency characteristic in the two-resonance helical antenna illustrated in FIGS. 2A and 2B.

Referring to FIG. 3, the two-resonance helical antenna was experimentally prepared and measured for a VSWR (Voltage/Standing Wave Ratio) versus frequency characteristic illustrated in the figure. Herein, the helical coil 3 has a length of 20 mm, an inner diameter of 4 mm, and the number of turns of 8. The conductor portion 5 has a width of 4 mm with its bottom end located at a level 6 mm higher than the bottom end of the helical coil 3.

As seen from FIG. 3, it is obvious that the two-resonance helical antenna has a two-resonance characteristic in which the first and the second resonance frequencies F1 and F2 are equal to 850 MHz and 1900 MHz, respectively. Thus, the two-resonance characteristic is achieved by the use of the single helical coil 3, i.e., without using the two helical coils as in the conventional antenna.

Figure 4A:
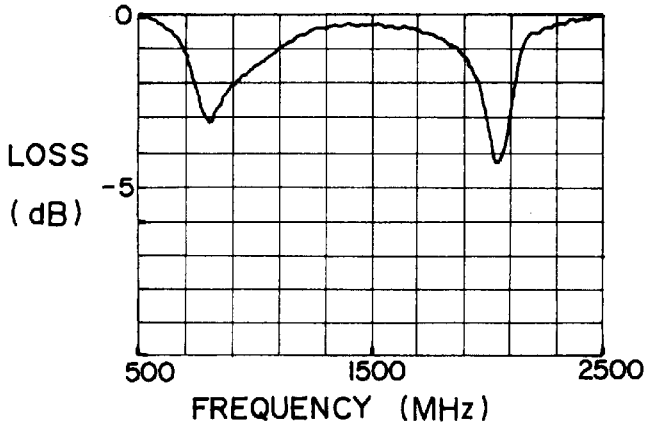
FIGS. 4A, 4B, and 4C are graphs showing the result of measurement of a gain loss in various positions of a conductor portion versus frequency characteristic in the two-resonance helical antenna illustrated in FIGS. 2A and 2B in different arrangements.
Figure 4B:
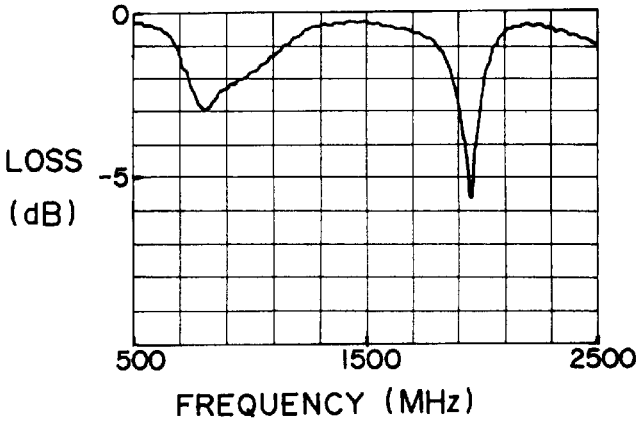
Figure 4C:
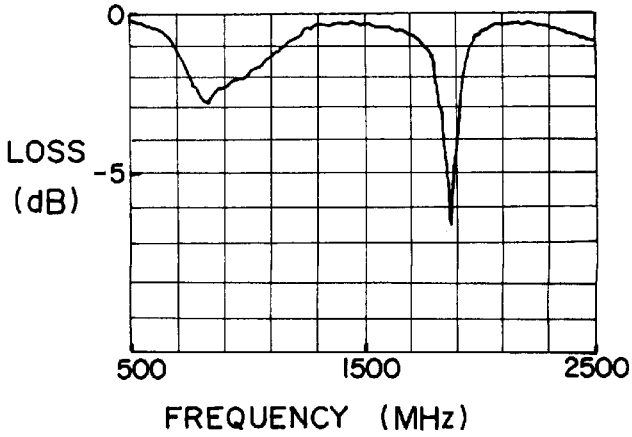

Referring to FIGS. 4A through 4C, the two-resonance helical antenna was measured for a gain loss in various positions of the conductor portion 5 versus frequency characteristic. The results shown in FIGS. 4A through 4C were obtained in case where the bottom end of the conductor portion 5 is located at levels 5 mm, 6 mm, and 7 mm higher than the bottom end of the helical coil 3, respectively.

From FIGS. 4A through 4C, it Is understood that the second resonance frequency F2 can readily be changed by simply varying the position of the conductor portion 5 without changing the first resonance frequency F1.

Figure 5A:
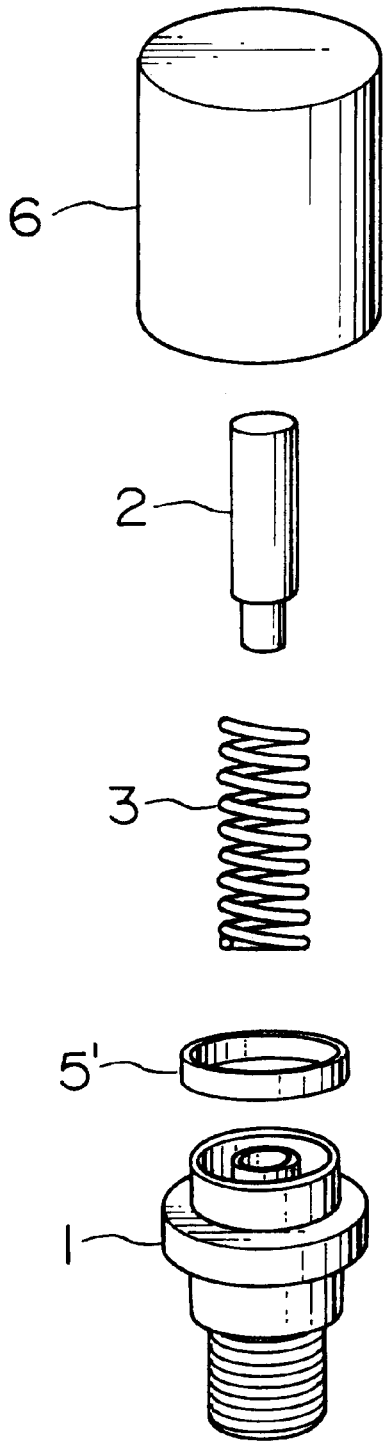
FIGS. 5A and 5B are an exploded perspective view and a partially-sectional side view of a two-resonance helical antenna according to a second embodiment of this invention.
Figure 5B:
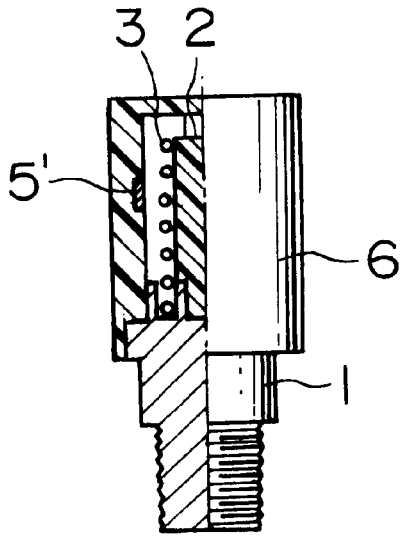

Referring to FIGS. 5A and 5B, in a two-resonance helical antenna according to a second embodiment of this invention, the holder 1 is made of a conductive material. The rod-shaped guide 2 is made of a dielectric material and having a small inner diameter. The single helical coil 3 is made of a conductive material, having a small inner diameter, and extending in one axis direction. The helical coil 3 is fitted to an outer peripheral surface of the guide 2 which serves to prevent the deformation and the unstableness of the helical coil 3. The guide 2 with the helical coil 3 fitted to its outer peripheral surface is fixedly attached to the holder 1.

The helical antenna further comprises a conductor portion 5' formed as a spring member of an annular shape. The conductor portion 5' is fixedly attached to an inner wall of the nonconductive cover 6. Finally, the above-mentioned components are covered with the nonconductive cover 6. Thus, the above-mentioned components are connected and arranged in a coaxial fashion.

In the two-resonance helical antenna thus assembled, the guide 2 with the helical coil 3 fitted on its outer peripheral surface is arranged inside the conductor portion 5' fitted in the inner wall of the cover 6. Thus, the conductor portion 5' is arranged around the helical coil 3 in a coaxial fashion to be spaced and insulated from the helical coil 3 and is positioned in a middle portion of a dimensional range of the helical coil 3 in the one axis direction. It is noted here that the helical coil 3 and the conductor portion 5' are spaced from each other at a distance x satisfying $0<x<0.1\lambda$, where $\lambda$ represents the wavelength of the resonance frequency (namely, the second resonance frequency F2) that is variable in response to the distance x.

As illustrated in FIGS. 5A and 5B, the conductor portion 5' is arranged at a level lower than the height of the helical coil 3. More in detail, the bottom end of the conductor portion 5' is arranged above the bottom end of the helical coil 3 while the top end of the conductor portion 5' is arranged below the top end of the helical coil 3.

The holder 1 is connected to a mobile terminal equipment (not shown). The holder 1 is made of a conductive material such as brass and has a threaded portion serving as a feeding portion. The helical coil 3 is made of a phosphor bronze wire formed into a helical shape and is electrically connected to the holder 1. The guide 2 is made of a dielectric material and supports the helical coil 3 fitted to its outer peripheral surface in tight contact therewith. It is thus possible to prevent the deformation and the unstableness of the helical coil 3. For example, the guide 2 is made of resin. The conductor portion 5' is made of a metal material such as aluminum. The conductor portion 5' is a spring member made of a metal material such as aluminum and is fitted into the inner wall of the nonconductive cover 6 to be inhibited from being shifted in position. By fixedly attaching the cover 6 to an end portion of the holder 1, the above-mentioned components are entirely covered so as to prevent the ingress of dust from outside.

In the two-resonance helical antenna having the above-mentioned structure, use is made of the single helical coil 3 with the conductor portion 5' formed around the helical coil 3 in a coaxial fashion to be spaced and insulated from the helical coil 3 and is positioned in a middle portion of a dimensional range of the helical coil 3 in the one axis direction. With this structure, the two-resonance helical antenna has a two-resonance characteristic, like the first embodiment described above. The second resonance frequency F2 can readily be changed by varying the position of the conductor portion 5' without changing the first resonance frequency F1. In the two-resonance helical antenna of this embodiment, the guide 4 of a greater inner diameter in the first embodiment is unnecessary. Therefore, the number of parts can be reduced further.

In both of the first and the second embodiments described above, the helical coil 3 has a wire-like shape. It will readily be understood that the similar effect is obtained if the helical coil 3 has a different but an appropriate shape. For example, the helical coil 3 may be a plate-like shape or may be a helical conductor formed by plating or vapor deposition. The conductor portion 5 or 5' serves to produce the floating capacitance between the conductor portion 5 or 5' and the helical coil 3. For this purpose, the conductor portion 5 or 5' of an annular shape need not be perfectly continuous but may be partially discontinuous.

As described above, in the two-resonance helical antenna according to this invention, use is made of the single helical coil 3 with the conductor portion 5 or 5' formed around the helical coil 3 in a coaxial fashion to be spaced and insulated therefrom and is positioned in a middle portion of the dimensional range of the helical coil 3 in the one axis direction. With this structure, a floating capacitance is produced between the conductor portion 5 or 5' and the helical coil 3 and parallel resonance is obtained between the floating capacitance and the inductance of the conductor portion 5. In this event, the first resonance frequency F1 is determined by the electrical length of the helical coil 3 while the second resonance frequency F2 of a desired level is obtained by electrically isolating the local area of the helical coil 3 form the conductor portion 5 or 5'. Thus, it is possible with a simple structure to assure a high degree of freedom in setting the first and the second resonance frequencies F1 and F2. This provides an industrial advantage. Furthermore, the degree of freedom in size of the helical coil 3 is also increased so that the antenna as a whole is reduced in size and weight. In addition, it is possible to suppress the fluctuation in electric characteristic as compared with the conventional antenna.

What is claimed is:

1. A two-resonance helical antenna comprising:

a single helical coil made of a conductive material and extending in an axial direction of the antenna; and an annular conductor portion arranged around said single helical coil in a coaxial fashion to be spaced and insulated from said single helical coil, wherein said annular conductor portion is arranged around said single helical coil at a middle portion of said single helical coil between first and second ends of said single helical coil in said axial direction of the antenna.

2. A two-resonance helical antenna as claimed in claim 1, wherein said single helical coil and said conductor portion are spaced from each other by a distance x satisfying $0<x<0.1\lambda$, where $\lambda$ represents a wavelength of a higher resonance frequency of the two-resonance helical antenna which is variable in response to said distance x.

3. A two-resonance helical antenna as claimed in claim 1, further comprising:

a conductive holder having a threaded portion serving as a feeding portion; and a cylindrical guide of a dielectric material fixedly attached to said holder and arranged around said single helical coil to be spaced and insulated from said single helical coil, wherein said conductor portion is formed by plating or vapor-depositing a conductive material in a local area on an outer peripheral surface of said guide.

4. A two-resonance helical antenna as claimed in claim 1, further comprising:

a conductive holder having a threaded portion serving as a feeding portion;

a rod-like guide made of a dielectric material fixedly attached to said holder, with said single helical coil being fitted onto an outer peripheral surface of said guide; and a nonconductive cover fixedly attached to said holder and covering an end portion of said holder and a whole of said guide with said single helical coil fitted thereto, wherein said conductor portion comprises a spring member fixedly attached to an inner wall of said cover.

* * * * *